US010414611B2

(12) United States Patent
Sakano

(10) Patent No.: US 10,414,611 B2
(45) Date of Patent: Sep. 17, 2019

(54) TAPE PRINTING APPARATUS AND TAPE PRINTING SYSTEM

(71) Applicant: SEIKO EPSON CORPORATION, Tokyo (JP)

(72) Inventor: Hideki Sakano, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/552,696

(22) PCT Filed: Jan. 19, 2016

(86) PCT No.: PCT/JP2016/000258
§ 371 (c)(1),
(2) Date: Aug. 22, 2017

(87) PCT Pub. No.: WO2016/136126
PCT Pub. Date: Sep. 1, 2016

(65) Prior Publication Data

US 2018/0044128 A1 Feb. 15, 2018

(30) Foreign Application Priority Data

Feb. 23, 2015 (JP) ..... 2015-033130

(51) Int. Cl.
*B65H 19/12* (2006.01)
*B41J 3/36* (2006.01)
(Continued)

(52) U.S. Cl.
CPC ..... *B65H 19/12* (2013.01); *B41J 3/36* (2013.01); *B41J 3/4075* (2013.01); *B41J 15/04* (2013.01); *B41J 17/32* (2013.01); *B65H 43/02* (2013.01)

(58) Field of Classification Search
CPC ..... B65H 19/12
(Continued)

(56) References Cited

U.S. PATENT DOCUMENTS 5,022,771 A * 6/1991 Paque ..... B41J 3/4075 156/389
5,518,328 A * 5/1996 Okuchi ..... B41J 3/4075 400/208
(Continued)

FOREIGN PATENT DOCUMENTS

CN 106715134 A 5/2017
EP 3 181 369 A1 6/2017
(Continued)

OTHER PUBLICATIONS

International Search Report dated Apr. 19, 2016 in PCT/JP2016/000258 with English-language translation (4 pgs.).
(Continued)

*Primary Examiner* — Anthony H Nguyen
(74) *Attorney, Agent, or Firm* — Foley & Lardner LLP

(57) ABSTRACT

A tape printing apparatus to which a tape cartridge is detachably attachable includes: a cartridge attachment portion into which the tape cartridge is attachable; and a base convex portion that is provided on the cartridge attachment portion, a core concave portion of the tape cartridge coming into fit-in engagement with the base convex portion when the tape cartridge is attached to the tape printing apparatus. The base convex portion includes: a pedestal portion with which a recessed portion of the tape cartridge comes into fit-in engagement when the tape cartridge is attached to the tape printing apparatus, and an identification convex portion that is provided as a protrusion on the pedestal portion, an identification concave portion of the tape cartridge coming into fit-in engagement with the identification convex portion
(Continued)

when the tape cartridge is attached to the tape printing apparatus.

10 Claims, 12 Drawing Sheets

(51) Int. Cl.
*B41J 15/04* (2006.01)
*B41J 17/32* (2006.01)
*B65H 43/02* (2006.01)
*B41J 3/407* (2006.01)

(58) Field of Classification Search
USPC ..... 400/208
See application file for complete search history.

(56) References Cited

U.S. PATENT DOCUMENTS

| | | | | |
|---|---|---|---|---|
| 6,485,206 | B1 * | 11/2002 | Takahashi | B41J 3/4075 400/120.16 |
| 2011/0292150 | A1 * | 12/2011 | Ishii | B41J 3/4075 347/110 |
| 2013/0089366 | A1 | 4/2013 | Kosuge | |
| 2015/0124041 | A1 | 5/2015 | Kosuge | |
| 2016/0159123 | A1 | 6/2016 | Sakano | |
| 2016/0214416 | A1 | 7/2016 | Kosuge | |
| 2017/0096022 | A1 | 4/2017 | Sakano | |
| 2017/0326892 | A1 | 11/2017 | Sakano | |
| 2018/0099515 | A1 | 4/2018 | Sakano | |
| 2018/0290467 | A1 | 10/2018 | Sakano | |

FOREIGN PATENT DOCUMENTS

| | | | |
|---|---|---|---|
| JP | 2000-052633 | A | 2/2000 |
| JP | 2000-103129 | A | 4/2000 |
| JP | 2008-194916 | A | 8/2008 |
| JP | 2011-245757 | A | 12/2011 |
| JP | 2012-006295 | A | 1/2012 |
| JP | 2014-014950 | A | 1/2014 |

OTHER PUBLICATIONS

Extended European Search Report dated Oct. 9, 2018 in related European Appl. 16754883.3 (7 pgs.).

* cited by examiner (a)

(b)

(a)

(b)

(a)

(b)

(c)

(a)

(b)

(a)

(b)

TAPE PRINTING APPARATUS AND TAPE PRINTING SYSTEM

CROSS REFERENCE TO RELATED APPLICATIONS

This application is a national stage entry of PCT/JP2016/000258, filed Jan. 19, 2016; which claims priority to Japanese Application No. 2015-033130, filed Feb. 23, 2015; the disclosures of which are herein incorporated by reference in their entirety.

TECHNICAL FIELD

The present invention relates to a tape printing apparatus that has a cartridge attachment portion into which a tape cartridge is attached, and a tape printing system.

BACKGROUND ART

In prior art, a print label creating apparatus that has a cassette attachment portion is known as a tape printing apparatus of this kind (see Patent Literature 1). A hollow guiding convex portion that guides the attachment of a tape cassette is provided on the cassette attachment portion, and an attachment sensor is built in the guiding convex portion. The attachment sensor includes a limit switch and a substantially L-shaped lever. The limit switch is mounted on a head holder and faces the inside of the guiding convex portion through a front-side opening formed in the guiding convex portion. On the other hand, the lever is provided in such a way as to be able to pivot freely inside the guiding convex portion. The rear end portion of the lever protrudes due to the urging force of the limit switch through the front-side opening formed in the guiding convex portion.

When a tape cassette is attached into the cassette attachment portion, the guiding concave portion of the tape cassette causes the lever to pivot so as to press the limit switch. As a result, the limit switch turns on, and the completion of the attachment of the tape cassette into the cassette attachment portion is detected.

CITATION LIST

Patent Literature

Patent Literature 1: Japanese Unexamined Patent Application Publication No. 2014-14950

SUMMARY OF INVENTION

Technical Problem

The application of a print label creating apparatus of this kind is growing wider, from office use to industrial use. Therefore, there is a trend of developing an apparatus and a tape cassette (tape) having printing conditions (specification) suited for intended use.

Amid the trend, although a print label creating apparatus according to prior art described above is capable of detecting the attachment of a tape cassette, the apparatus is not capable of detecting whether the detected tape cassette is in conformity with a standard that matches with the specification of the apparatus or not. For this reason, there is a possibility that predetermined print quality will not be obtained in a case where a tape cassette that is in conformity with a standard that does not match with the specification of the apparatus is attached.

An object of the present invention is to provide a tape printing apparatus that makes it possible to discern, by attachment, whether a tape cartridge matches with the specification of the apparatus or not, and to provide a tape printing system.

Solution to Problem

A tape printing apparatus according to the present invention is an apparatus to which a tape cartridge is detachably attached, the tape cartridge including a core shaft portion, a roll of printing tape being on an outer circumferential portion of the core shaft portion, a core concave portion being formed as an inner circumferential portion of the core shaft portion, the core concave portion including a recessed portion and a to-be-identified portion, the to-be-identified portion being provided in the recessed portion for identification of a cartridge type, the apparatus comprising: a cartridge attachment portion into which the tape cartridge is attached; and a base convex portion that is provided on the cartridge attachment portion, the core concave portion coming into fit-in engagement with the base convex portion when the tape cartridge is attached, the base convex portion including a pedestal portion with which the recessed portion comes into fit-in engagement and including an identifying portion that is provided on the pedestal portion, the to-be-identified portion coming into fit-in engagement with the identifying portion.

In this structure, the attachment of the tape cartridge into the cartridge attachment portion brings the to-be-identified portion of the core concave portion for identification of a cartridge type into fit-in engagement with the identifying portion of the base convex portion. Since the to-be-identified portion comes into fit-in engagement with the identifying portion, it is possible to confirm that the tape cartridge matches with the specification of the tape printing apparatus. On the other hand, in a case where the to-be-identified portion does not come into fit-in engagement with the identifying portion, the fitting failure makes it possible to confirm that the tape cartridge does not match with the specification of the tape printing apparatus. That is, it is possible to discern whether the tape cartridge matches with the specification of the apparatus or not on the basis of whether the tape cartridge has been attached properly into the cartridge attachment portion or not.

The to-be-identified portion is provided in the recessed portion, and the identifying portion is provided on the pedestal portion, with which the recessed portion comes into fit-in engagement; therefore, before the start of the fit-in engagement of the to-be-identified portion with the identifying portion, the recessed portion collides with the identifying portion, thereby correcting the orientation of the tape cartridge. Therefore, providing the identifying portion of the base convex portion does not impair smooth tape cartridge attachment.

In this case, preferably, the to-be-identified portion should include an identification concave portion that is provided as a recess from the recessed portion; and the identifying portion should include an identification convex portion that is provided as a protrusion on the pedestal portion.

With this structure, it is possible to cause the base convex portion (identification convex portion) to function also as a tape cartridge attachment guide and as a positioning member.

In these cases, preferably, the identification concave portion should include a first concave portion that extends in a radial direction; and the identification convex portion should include a first convex portion with which the first concave portion comes into fit-in engagement.

This makes it possible to make the structure of the first convex portion simple and makes it possible to provide the first convex portion at an arbitrary position in the circumferential direction of the identification convex portion. That is, it is possible to identify the type of the cartridge with a simple structure.

Preferably, the to-be-identified portion should include a second convex portion that is provided on the recessed portion and extends in a radial direction; and the identifying portion should include a second concave portion that is provided in the pedestal portion and with which the second convex portion comes into fit-in engagement.

This makes it possible to make the structure of the second concave portion simple and makes it possible to provide the second concave portion at an arbitrary position in the circumferential direction of the pedestal portion. That is, it is possible to identify the type of the cartridge with a simple structure. Moreover, with the cooperative functioning of the first convex portion and the second concave portion, it is possible to increase the number of types of tape cartridge identified.

On the other hand, preferably, the to-be-identified portion should include an operating portion; and the identifying portion should further include a detection portion with which the operating portion comes into fit-in engagement when attached, and the detection portion is operated by the operating portion to perform detection.

With this structure, it is possible to confirm that the tape cartridge matches with the specification of the apparatus, and, at the same time, it is possible to detect the attachment of the tape cartridge matching with the specification of the apparatus.

In this case, preferably, the to-be-identified portion should include an identification concave portion that is provided as a recess from the recessed portion; the operating portion should include a first operating portion that is provided in the identification concave portion and extends in a radial direction; the identifying portion should include an identification convex portion that is provided as a protrusion on the pedestal portion; and the detection portion should include a first to-be-operated portion that is provided on the identification convex portion for fit-in engagement with the first operating portion and is operated by the first operating portion, and a first detection portion body that is activated by the first to-be-operated portion for detection.

With this structure, since the detection portion includes the first to-be-operated portion and the first detection portion body, it is possible to enhance the degree of freedom in providing the first to-be-operated portion and the first detection portion body without impairing the detection function. That is, it is possible to arrange the first to-be-operated portion and the first detection portion with high space efficiency, and it is possible to keep the compact size of the apparatus despite the fact that the detection portion is provided.

In this case, preferably, the first to-be-operated portion should be provided in such a way as to be able to slide freely in a direction of attachment and detachment of the tape cartridge on an inner circumferential surface of the identification convex portion.

With this structure, it is possible to utilize the inner circumferential surface of the identification convex portion as an operation guide for the first to-be-operated portion. In addition, it is possible to arrange the first to-be-operated portion with high space efficiency.

Preferably, the operating portion should include a second operating portion that is provided on the recessed portion and extends in a radial direction; and the detection portion should include a second to-be-operated portion that is provided in the pedestal portion for fit-in engagement with the second operating portion and is operated by the second operating portion, and a second detection portion body that is activated by the second to-be-operated portion for detection.

With this structure, since the detection portion includes the second to-be-operated portion and the second detection portion body, it is possible to enhance the degree of freedom in providing the second to-be-operated portion and the second detection portion body without impairing the detection function. That is, it is possible to arrange the second to-be-operated portion and the second detection portion with high space efficiency, and it is possible to keep the compact size of the apparatus despite the fact that the detection portion is provided. Moreover, with the cooperative functioning of the first to-be-operated portion and the second to-be-operated portion, it is possible to increase the number of types of tape cartridge identified; in addition, with the cooperative functioning of the first detection portion body and the second detection portion body, it is possible to detect these kinds of the tape cartridge reliably.

In this case, preferably, the second to-be-operated portion should be provided in such a way as to be able to slide freely in a direction of attachment and detachment of the tape cartridge on an inner circumferential surface of the pedestal portion.

With this structure, it is possible to utilize the inner circumferential surface of the pedestal portion as an operation guide for the second to-be-operated portion. In addition, it is possible to arrange the second to-be-operated portion with high space efficiency.

A tape printing system according to the present invention comprises: the tape printing apparatus described above; and the tape cartridge that is detachably attached into the cartridge attachment portion.

With this structure, it is possible to discern whether the tape cartridge matches with the specification of the apparatus or not. Therefore, it is possible to obtain predetermined print quality.

DESCRIPTION OF EMBODIMENTS

With reference to the accompanying drawings, a tape printing apparatus and a tape printing system according to an embodiment of the present invention will now be explained. The tape printing apparatus performs printing while unreeling a printing tape and an ink ribbon from an attached tape cartridge, and cuts a printed part of the printing tape off to create a label (tape strip). The tape printing system is made up of the tape printing apparatus and a tape cartridge, which is attached for use to the tape printing apparatus.

[Overview of Tape Printing Apparatus]

Figure 1:
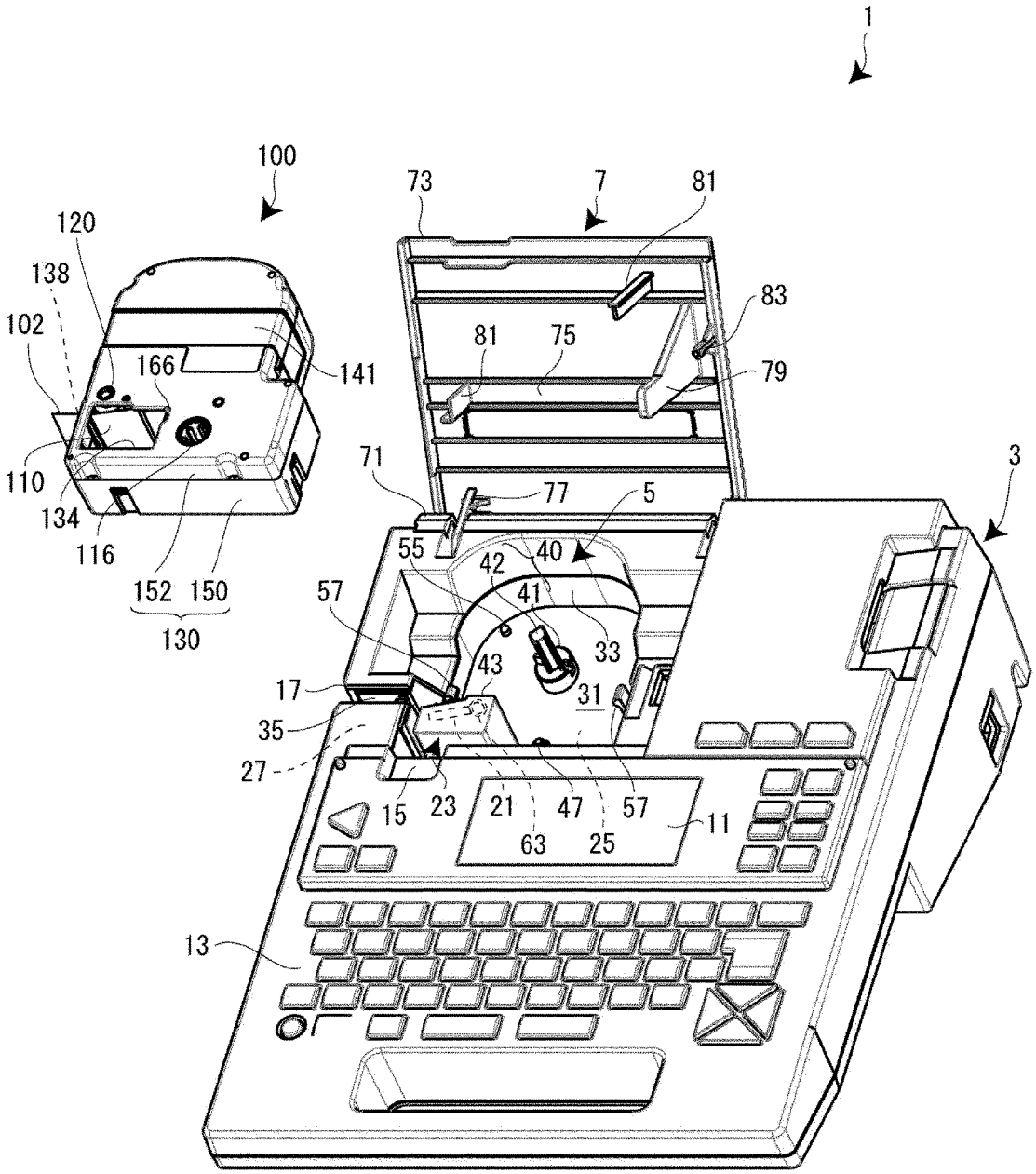
FIG. 1 An external perspective view of a tape printing apparatus (with a cover opened) and a tape cartridge constituting a tape printing system according to an embodiment.

FIG. 1 is an external perspective view of a tape printing apparatus and a tape cartridge attached thereto. As illustrated therein, a tape printing apparatus 1 includes an apparatus case 3, of which the exterior of the tape printing apparatus 1 is made, a cartridge attachment portion 5, into which a tape cartridge 100 is to be detachably attached, and an open/close cover 7, which opens and closes for the cartridge attachment portion 5. The cartridge attachment portion 5 is provided beneath the far side of the top of the apparatus case 3, and a display 11 and a keyboard 13 are provided respectively on the center and the near side thereof. There is a recessed portion 15, into which a finger is to be inserted, near the open/close cover 7. To open the open/close cover 7, a finger is inserted into the recessed portion 15, and the finger-hooked cover is pulled up. A vertically elongated tape exit 17, from which a printing tape 102 goes out, is provided in a side (left side) of the apparatus case 3.

The tape printing apparatus 1 further includes a printing mechanical portion 23, which is provided upright in the cartridge attachment portion 5 and includes a print head 21, a tape feeding mechanical portion 25, which is built in the cartridge attachment portion 5, and a tape cutting mechanical portion 27, which is built near the tape exit 17.

A user inputs print information via the keyboard 13, confirms the print information on the display 11, and then instructs that printing be executed by performing key operation. Upon the print instruction, the tape feeding mechanical portion 25 is driven, thereby causing the printing tape 102 to travel together with an ink ribbon 110. Due to heat applied to the ink ribbon 110 from the printing mechanical portion 23, ink on the ink ribbon 110 transfers to the printing tape 102. Printing is performed in this way. Because of the print feeding, the printing tape 102 goes out from the tape exit 17 continuously, and, upon completion of the printing, the tape cutting mechanical portion 27 is driven to cut the printed part of the printing tape 102 off.

[Overview of Tape Cartridge]

Figure 2:
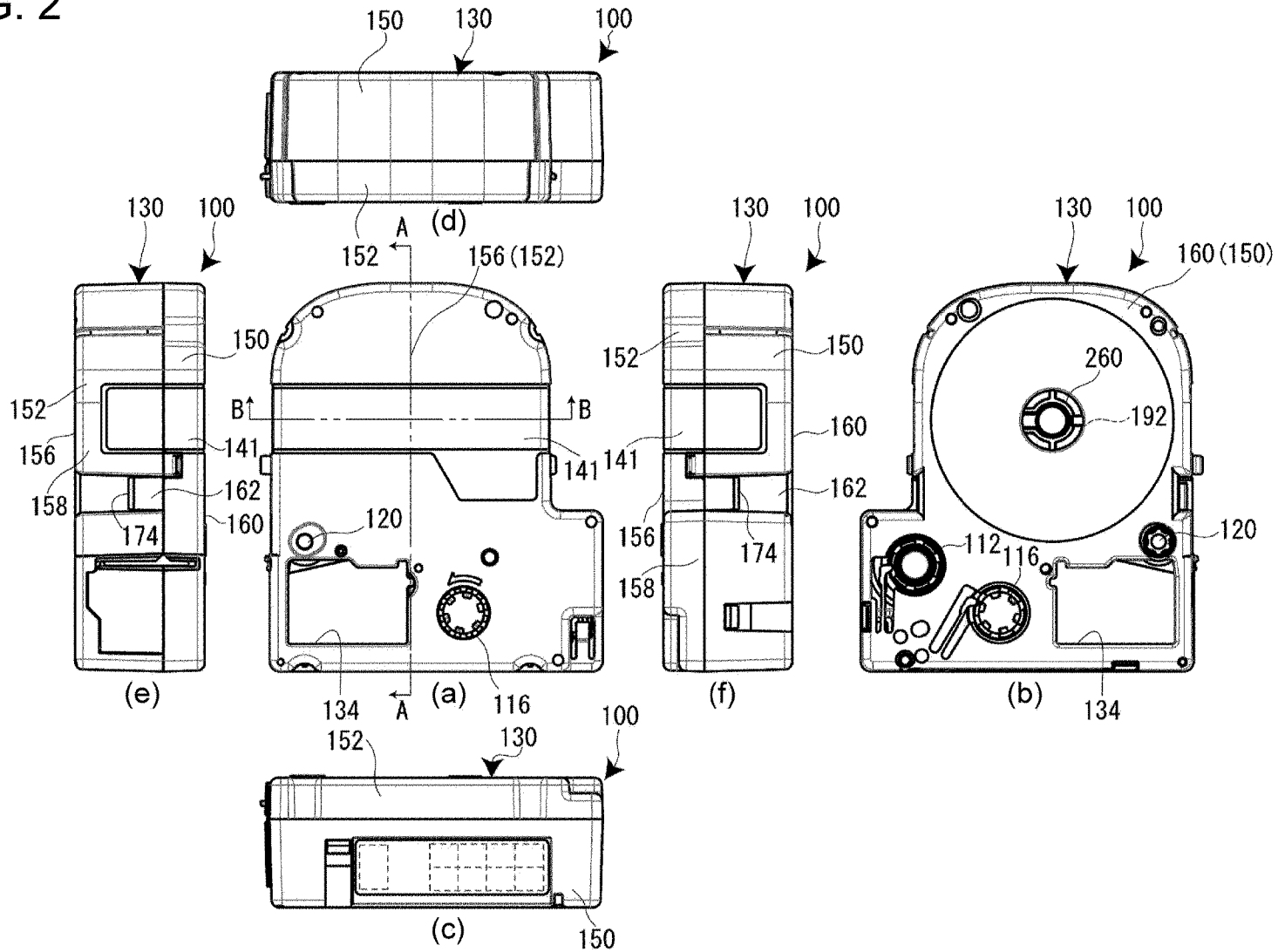
FIG. 2 A plan view (a), a back view (b), a front elevation view (c), a rear elevation view (d), a left elevation view (e), and a right elevation view (f) of a tape cartridge according to an embodiment.
Figure 7:
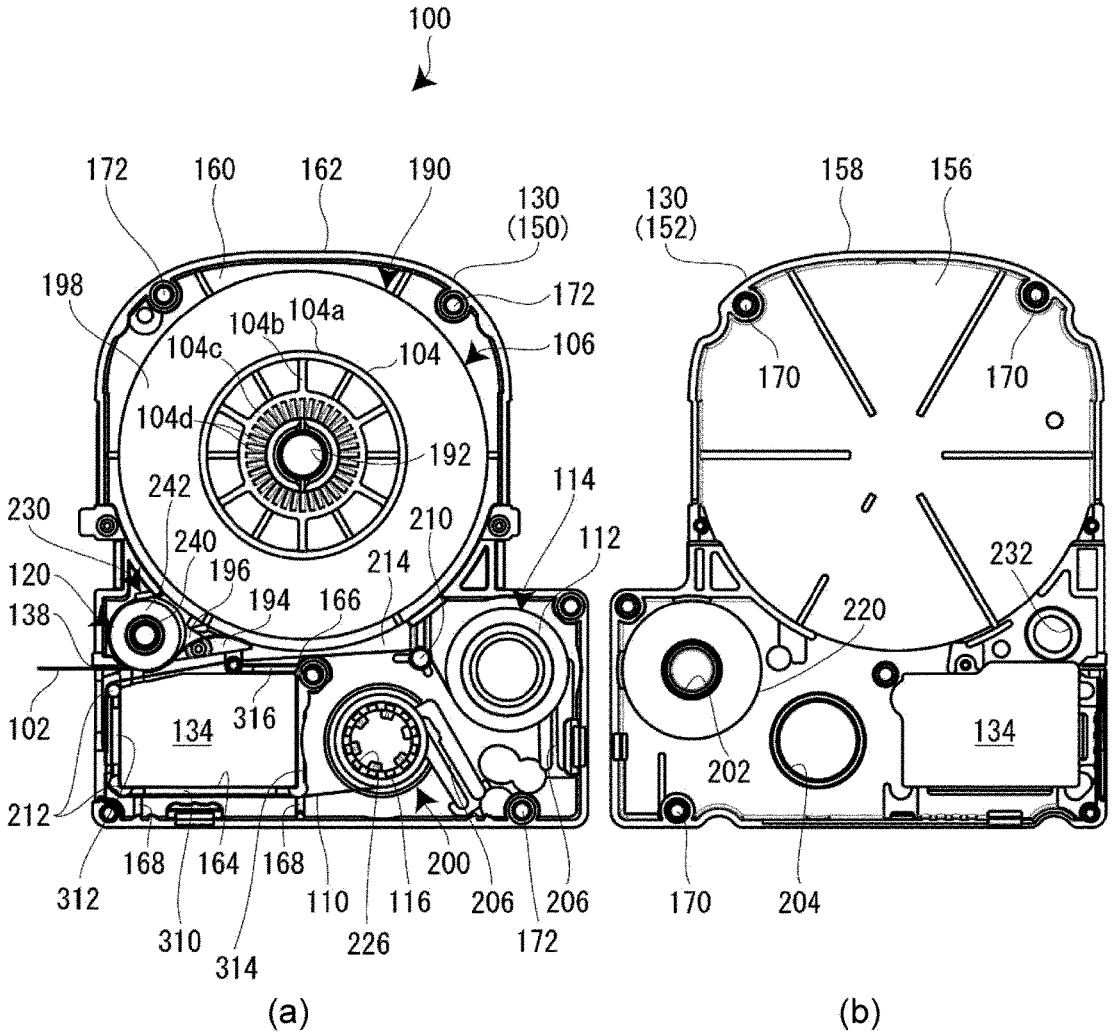
FIG. 7 A plan view (a) of a tape cartridge with an upper case removed, and a back view (b) of the upper case.

As illustrated in FIGS. 2 and 7, the tape cartridge 100 includes a tape roll 106, which is a roll of the printing tape 102 around a tape core 104, and a ribbon roll 114, which is a roll of the ink ribbon 110 around an unreeling core 112. The tape cartridge 100 further includes a reeling core 116, which takes up the used ink ribbon 110, and a platen roller 120 (platen), which feeds the printing tape 102 and the ink ribbon 110, wherein the print head 21 is configured to be brought into indirect contact with the platen, with the ink ribbon 110 and the printing tape 102 therebetween. The tape cartridge 100 further includes a cartridge case 130, in which the tape roll 106, the ribbon roll 114, the reeling core 116, and the platen roller 120 are housed. As described above, the tape cartridge 100 of the present embodiment has a so-called shell structure, the enclosure of which is the cartridge case 130.

An insertion opening 134, into which the print head 21 is inserted at the time of attachment of the tape cartridge 100 to the tape printing apparatus 1, is formed in the cartridge case 130 thereof. The tape cartridge 100 has a tape feed outlet 138, which is formed in the cartridge case 130 to feed out the printing tape 102. The tape roll 106 is supported rotatably on a cylindrical core shaft portion 192, which protrudes inside the cartridge case 130 (see FIG. 4). A detailed explanation thereof will be given later.

When the platen roller 120 and the reeling core 116 are driven by the tape feeding mechanical portion 25 described above, the printing tape 102 is unreeled from the tape core 104, and the ink ribbon 110 is unreeled from the unreeling core 112. The unreeled printing tape 102 and the unreeled ink ribbon 110 travel together at the region of the platen roller 120 and are used for printing by the print head 21. The unreeled end part of the printing tape 102 after the printing (the printed part) is fed out from the tape feed outlet 138 toward the tape exit 17. On the other hand, the ink ribbon 110 goes around the surrounding walls of the insertion opening 134 to be reeled onto the reeling core 116. Plural types of the tape cartridge 100 that differ in thickness from one to another in accordance with a variety of widths of the printing tape 102 are available.

[Details on Tape Printing Apparatus]

Figure 5:
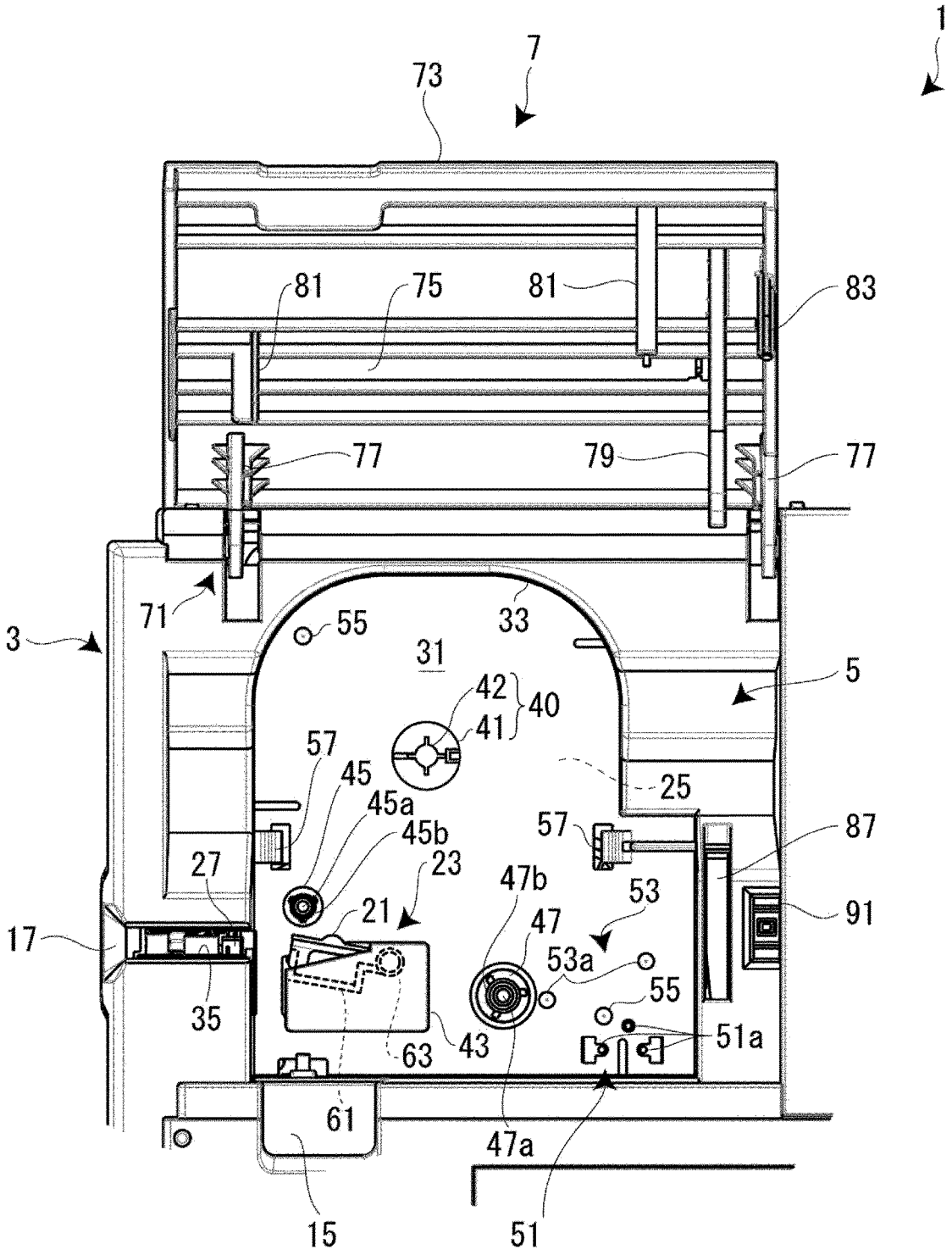
FIG. 5 A plan view of a cartridge attachment portion.

As illustrated in FIGS. 1 and 5, the cartridge attachment portion 5 has a two-dimensional shape that is complementary to the two-dimensional shape of the tape cartridge 100. In addition, the cartridge attachment portion 5 is formed as a cavity that has a depth corresponding to, among plural types of the tape cartridge 100 that are attachable, the tape cartridge 100 of the greatest thickness. In this structure, an attachment base 31, which is the bottom plate portion of the cartridge attachment portion 5, is formed (molded) integrally with a sidewall portion 33 by means of resin or the like. A slit-like tape ejection path 35 is formed between the cartridge attachment portion 5 and the tape exit 17 described above. The tape cutting mechanical portion 27 described above is built in this region.

A base convex portion 40, which fits into the inner circumferential portion of the core shaft portion 192 of the tape cartridge 100 (see FIG. 4) when the tape cartridge 100 is attached, is provided upright on the attachment base 31 of the cartridge attachment portion 5. The base convex portion 40 includes a circular pedestal portion 41, which is provided upright on the attachment base 31, and an identification convex portion 42, which is provided upright on the pedestal portion 41. A detailed explanation thereof will be given later.

In addition, the print head 21, which is enclosed by a head cover 43, a platen drive shaft 45, which causes the platen roller 120 to rotate, and a reeling drive shaft 47, which causes the reeling core 116 to rotate, are provided upright on the attachment base 31. A tape detection portion 51, which detects the type (attribute information) of the printing tape 102, and a core release portion 53, which releases the rotation stopper of the unreeling core 112 and the reeling core 116, are provided on the attachment base 31 at positions near the reeling drive shaft 47.

A pair of small protrusions 55 is provided on the attachment base 31 at diagonal positions. In addition, a pair of latching pieces 57, which is configured to hook onto the middle portion of the attached tape cartridge 100, is provided on the attachment base 31. The tape feeding mechanical portion 25 described above, which includes a motor and gear trains (both omitted in the illustration) for causing the platen drive shaft 45 and the reeling drive shaft 47 to rotate, is built in a space under the back of the attachment base 31. The tape feeding mechanical portion 25 branches motive power out by means of the gear trains, thereby causing the platen drive shaft 45 and the reeling drive shaft 47 to rotate in synchronization with each other.

The printing mechanical portion 23 includes the print head 21, which is a thermal head, and a head supporting frame 61, by which the print head 21 is supported and via which the print head 21 is caused to turn. The printing mechanical portion 23 further includes a head release mechanism (not illustrated), which causes the print head 21 to turn via the head supporting frame 61 between a printing position and a retracted position, and the head cover 43, by which the print head 21 (and the head supporting frame 61) is enclosed.

The head release mechanism operates in linkage with the opening and closing of the open/close cover 7 described above. Specifically, the head release mechanism moves (turns) the print head 21 to the printing position in linkage with the closing of the open/close cover 7. The head release mechanism moves (turns) the print head 21 to the retracted position in linkage with the opening of the open/close cover 7. The print head 21 having been moved to the printing position is in indirect contact with the platen roller 120, with the ink ribbon 110 and the printing tape 102 therebetween. The print head 21 having been moved to the retracted position is away from the platen roller 120. This prevents the printing tape 102 and the ink ribbon 110 from colliding with the print head 21 at the time of attachment or detachment of the tape cartridge 100.

The print head 21 includes a plurality of heat generation elements. The plural heat generation elements are arranged in a line in the same direction as the direction of the shaft of the platen roller 120. Printing is performed as a result of the feeding of the printing tape 102 and the ink ribbon 110 and the selective driving of the plural heat generation elements. The head cover 43 has a substantially rectangular shape in plan view, and is formed (molded) integrally with the attachment base 31 (cartridge attachment portion 5) described above. The head cover 43 protrudes perpendicularly from the attachment base 31, and tolerates the turning of the print head 21 inside.

The tape detection portion 51 is made up of a plurality of micro switches 51*a*. They are configured to be selectively engaged with the to-be-detected portion 180 of the tape cartridge 100 described later, thereby detecting the type of the printing tape 102 such as tape width, tape color, and material, etc. The driving of the print head 21 and the tape feeding mechanical portion 25 is controlled on the basis of the results of the detection.

The core release portion 53 is made up of two release pins 53*a*, one for the unreeling core 112 and the other for the reeling core 116. Rotation stopper hooks 206, which are latched onto the unreeling core 112 and the reeling core 116 respectively as will be described in detail later, are provided in the cartridge case 130 (see FIG. 6). The release pins 53*a* become engaged with the rotation stopper hooks 206 when the tape cartridge 100 is attached. The pin engagement releases the rotation stopper of the unreeling core 112 and the reeling core 116.

The platen drive shaft 45 includes a fixed support shaft 45*a*, which is provided through the platen roller 120, and a spline drive shaft 45*b*, which has a spline shape and is rotatably supported on the base portion of the fixed support shaft 48 (see FIG. 5). The rotational power of the tape feeding mechanical portion 25 is transmitted to the spline drive shaft 45*b* and is thereafter transmitted from the spline drive shaft 45*b* to the platen roller 120 (a detailed explanation thereof will be given later).

Similarly, the reeling drive shaft 47 includes a fixed shaft 47*a* and a movable shaft 47*b*. The movable shaft 47*b* has a spline shape and is rotatably supported on the fixed shaft 47*a*. The rotational power of the tape feeding mechanical portion 25 is, also in this case, transmitted to the movable shaft 47*b* and is thereafter transmitted from the movable shaft 47*b* to the reeling core 116.

The attachment of the tape cartridge 100 into the cartridge attachment portion 5 brings the core shaft portion 192 (core concave portion 260 described later) into engagement with the base convex portion 40 (see FIG. 10), brings the platen roller 120 into engagement with the platen drive shaft 45, and brings the reeling core 116 into engagement with the reeling drive shaft 47. Then, the closing of the open/close cover 7 turns the print head 21 and brings the print head 21 into contact with the platen roller 120, with the printing tape 102 and the ink ribbon 110 nipped therebetween, thereby putting the tape printing apparatus 1 into a print standby state.

Figure 6:
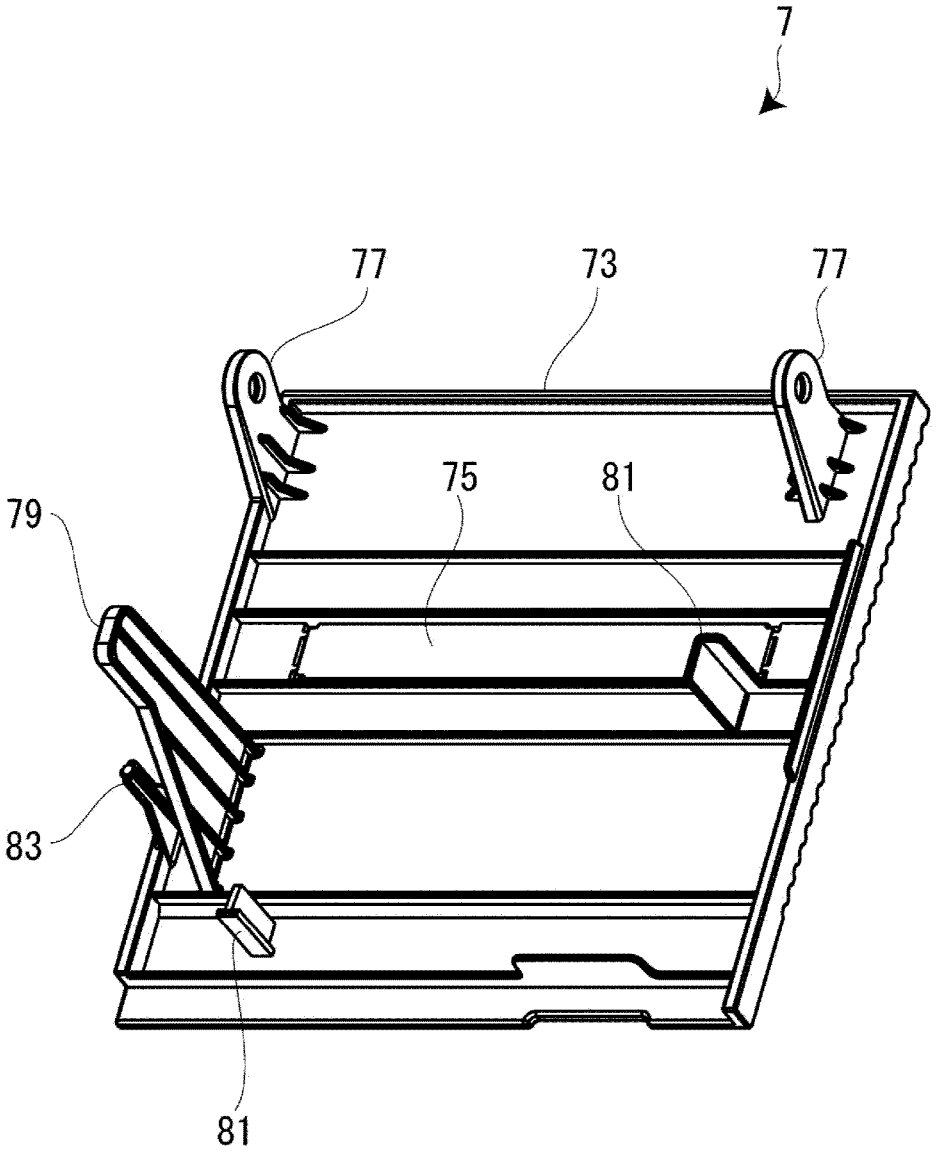
FIG. 6 A perspective view, from the back, of an open/close cover.

As illustrated in FIGS. 1, 5, and 6, the open/close cover 7 is attached rotatably to the apparatus case 3 via a hinge portion 71 provided at the far end, that is, attached thereto in such a way as to be able to open and close freely. The open/close cover 7 includes an open/close cover body 73 and a see-through window 75, which is provided at the center of the open/close cover body 73. The open/close cover 7 includes a pair of bearing pieces 77, which protrudes from the back of the open/close cover body 73 and is rotatably supported at the hinge portion 71, and an actuating lever 79, which protrudes from the back of the open/close cover body 73 and is configured to cause the print head 21 to turn. The open/close cover 7 further includes two pushing protrusions 81, which protrude from the back of the open/close cover body 73 and are configured to push the tape cartridge 100, and a pressing-down protrusion 83, which protrudes from the back of the open/close cover body 73 and is configured to activate (ON) a built-in closing-of-the-cover detection switch (not illustrated).

The see-through window 75 is horizontally elongated, and is made of transparent resin (transmissive to visible light) distinct from the open/close cover body 73. It is possible to visually confirm the tape cartridge 100 (the type of the printing tape 102, the amount of the tape left) having been attached into the cartridge attachment portion 5 through the see-through window 75. The pair of bearing pieces 77, the actuating lever 79, the two pushing protrusions 81, the pressing-down protrusion 83, and the open/close cover body 73 are formed (molded) of resin integrally.

The actuating lever 79 protrudes as a large protruding piece from the back of the open/close cover body 73, and is configured to be inserted into a slit opening 87, which is provided alongside the cartridge attachment portion 5, when the open/close cover 7 is closed. The actuating lever 79 having been inserted into the slit opening 87 actuates the head release mechanism described above, thereby causing the print head 21 to turn toward the platen roller 120. Similarly, the pressing-down protrusion 83 is configured to be inserted into a rectangular opening 91, which is provided adjacent to the slit opening 87, when the open/close cover 7 is closed, thereby turning the closing-of-the-cover detection switch ON.

One of the two pushing protrusions 81 is provided at a position corresponding to a position near the platen roller 120 of the tape cartridge 100. The other pushing protrusion 81 is provided at a position corresponding to a position just above the tape detection portion 51 described above. When the open/close cover 7 is closed, the two pushing protrusions 81 push the tape cartridge 100 so that the tape cartridge 100 becomes seated on the attachment base 31 of the cartridge attachment portion 5, and prevent the tape cartridge 100 from getting out of the seat upward.

[Details on Tape Cartridge]

Next, with reference to FIGS. 2 to 4, and 7, the tape cartridge 100 will now be explained in detail. In the explanation of the tape cartridge 100, FIG. 1 is taken as an example, and the faces of the tape cartridge 100 are named as follows: the near face in the attachment direction corresponding to the top of the tape cartridge 100 is called as "front"; the far face that is the opposite face in the attachment direction is called as "back"; the left side face is called as "left side"; the right side face is called as "right side"; the upper rounded side face is called as "distal end"; and the lower side face is called as "proximal end".

As described above, the tape cartridge 100 includes the cartridge case 130, and further includes the tape roll 106, the ribbon roll 114, the reeling core 116, and the platen roller 120, which are housed therein (see FIG. 7). In addition, the tape cartridge 100 has the insertion opening 134, which is formed in the cartridge case 130, the tape feed outlet 138, which is formed in the left side near the platen roller 120, and an identification sticker 141 (see FIG. 1), which is bonded, to the region where the tape roll 106 is housed, from the left side to the right side across the front. At two places, specifically, on the front and the left side, the identification sticker 141 shows information on the width, color, and material, etc. of the printing tape 102 that is housed therein.

The cartridge case 130 is the exterior of the tape cartridge 100 (shell structure), and has a shape that looks like a letter "L" in plan view, meaning that the proximal-end portion of the right side is bulged to some extent. In the front-back direction, the cartridge case 130 includes a lower case 150, which is the farther counterpart when attached into the cartridge attachment portion 5, and an upper case 152, which is the nearer counterpart when attached into the cartridge attachment portion 5. In the cartridge case 130 of the present embodiment, the upper case 152 is a molded part that is made of transparent resin, and the lower case 150 is a molded part that is made of opaque resin.

To constitute the upper case 152, a top wall portion 156, which corresponds to the front of the cartridge case 130, and an upper peripheral wall portion 158, which is a portion hanging from the periphery of the top wall portion 156, are formed (molded) integrally. To constitute the lower case 150, a bottom wall portion 160, which corresponds to the back of the cartridge case 130, a lower peripheral wall portion 162, which is a portion rising from the periphery of the bottom wall portion 160, and an around-opening surrounding wall portion 164, which is a portion rising from the bottom wall portion 160 so as to enclose the insertion opening 134 described above, are formed (molded) integrally.

Plural joint pins 170 are provided at arbitrary intervals on the bottom edge of the upper peripheral wall portion 158 of the upper case 152, and plural joint holes 172 corresponding to the plural joint pins 170 are provided in the lower peripheral wall portion 162 of the lower case 150 (see FIG. 7). After the setting of constituent parts such as the tape roll 106 and the ribbon roll 114, etc. into the lower case 150, the upper case 152 and the lower case 150 are joined together in such a way as to press-fit the plural joint pins 170 into the plural joint holes 172. The tape cartridge 100 is assembled in this way. Each of the joint holes 172 is formed as a through hole in consideration of easier molding.

A pair of latch receptacles 174, onto which the pair of latching pieces 57 described above is configured to hook, is provided on the left side and the right side of the lower case 150 (see FIGS. 2(*e*), (*f*), and 3(*b*)). The latching engagement of the pair of latching pieces 57 of the cartridge attachment portion 5 with the pair of latch receptacles 174 of the attached tape cartridge 100 prevents the tape cartridge 100 from getting out of the seat upward. Small engagement holes 176, into which the pair of small protrusions 55 described above is to be inserted with a slight margin, are formed in the back of the lower case 150 (see FIG. 3(*b*)). The inserting engagement of the pair of small protrusions 55 of the cartridge attachment portion 5 with the pair of small engagement holes 176 of the attached tape cartridge 100 serves for simple positioning of the tape cartridge 100 on the attachment base 31.

Figure 3:
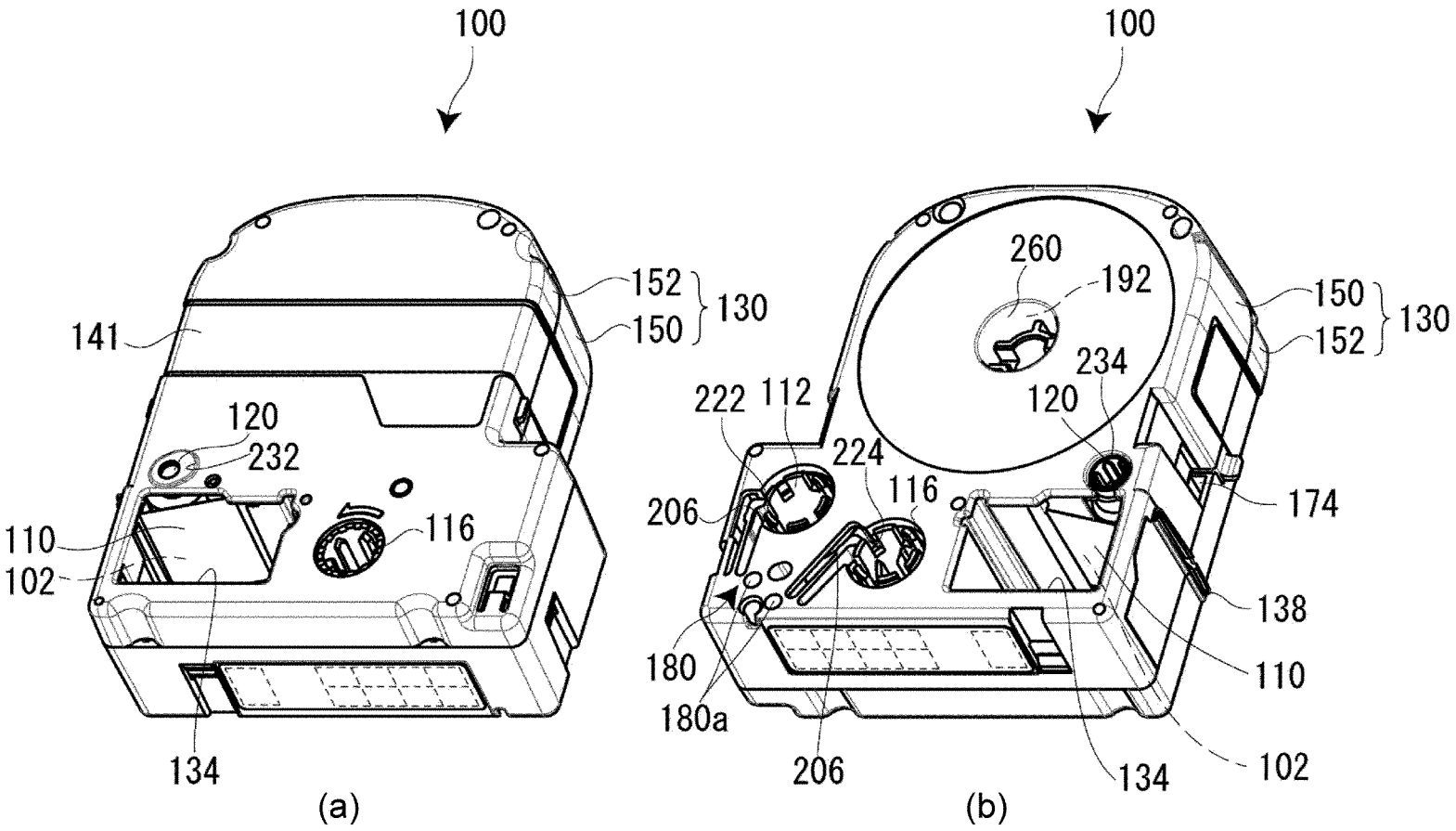
FIG. 3 A top perspective view (a), and a back perspective view (b) of a tape cartridge according to an embodiment.

The to-be-detected portion 180, which corresponds to the tape detection portion 51 described above, is provided on the back of the lower case 150 at the proximal-end-side left corner (right corner as viewed from the front) (see FIG. 3(*b*)). The to-be-detected portion 180 is a portion having a structure corresponding to the plural micro switches 51*a* of the tape detection portion 51, and a plurality of bit patterns is able to be obtained on the basis of the presence or absence of counterpart holes 180*a* provided at this region. That is, the bit pattern corresponds to the type of the printing tape 102 described above.

Figure 4:
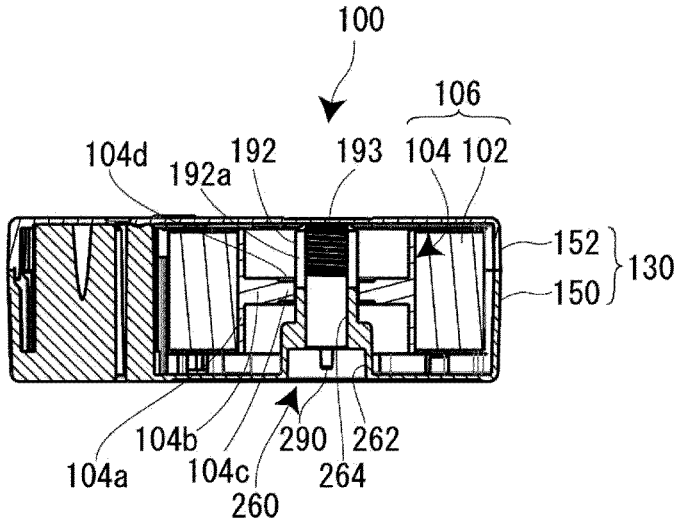
FIG. 4 A cross-sectional view (a) taken along the line A-A of FIG. 2(*a*), and a cross-sectional view (b) taken along the line B-B thereof.
Figure 4:
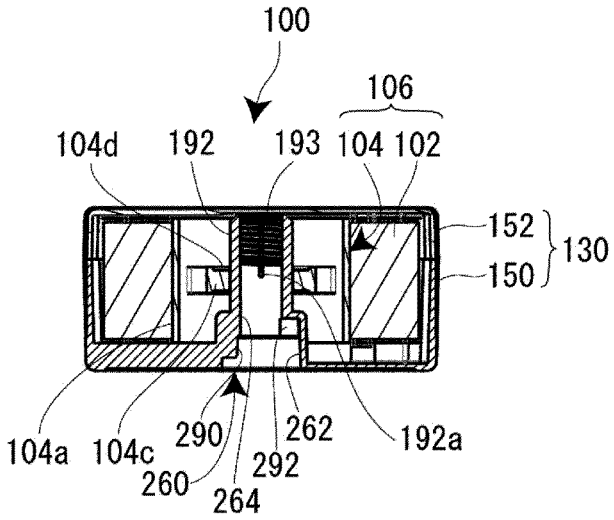

As illustrated in FIGS. 4 and 7, the upper-side space (at the distal-end side) inside the cartridge case 130 is a wide tape housing area 190 where the tape roll 106 is housed. The core shaft portion 192, which is formed (molded) integrally with the lower case 150, is provided upright at the center of the tape housing area 190. The core shaft portion 192 has a tiered cylindrical shape. The tape roll 106 (tape core 104) is supported rotatably on the outer circumferential surface 192*b* of the core shaft portion 192 (see FIG. 4).

As will be described in detail later, the core shaft portion 192 having a tiered cylindrical shape has the core concave portion 260 as its inner circumferential portion, and the base convex portion 40 described above is to fit into the core concave portion 260. The core concave portion 260 includes a recessed portion 262, into which the pedestal portion 41 of the base convex portion 40 is to fit, and an identification concave portion 264, into which the identification convex portion 42 of the base convex portion 40 is to fit. In addition, a reverse rotation stopper spring 193, which is a coil spring for preventing the reverse rotation of the tape roll 106, is built in at the upper region of the core concave portion 260.

As illustrated in FIG. 7, a tape guide 194 for guiding the unreeled printing tape 102 to the platen roller 120 is provided upright integrally with the lower case 150 in the tape housing area 190 at a position near the platen roller 120. That is, a tape feeding path 196, which leads from the tape roll 106 to the tape feed outlet 138 via the tape guide 194 and the platen roller 120, is provided inside the cartridge case 130. The printing tape 102 having been unreeled from the tape roll 106 is guided through the tape guide 194 to the platen roller 120, is used for printing at the platen roller 120, and is further guided from the platen roller 120 to the tape feed outlet 138.

The tape roll 106 includes the printing tape 102 and the tape core 104. The tape roll 106 further includes two circular films 198, which are bonded respectively to the two edge faces of the roll-shaped printing tape 102. The two circular films 198 prevent the printing tape 102 wrapped around the tape core 104 from coming apart.

As illustrated in FIGS. 4 and 7, the tape core 104 includes a reel portion 104*a*, around which the printing tape 102 is wrapped, and a rotation contact portion 104*c*, which is provided inside the reel portion 104*a*, with a plurality of inward ribs 104*b* provided therebetween. The rotation contact portion 104*c* is supported rotatably on the core shaft portion 192 described above. A plurality of radiating edge face grooves 104*d* is formed on an edge face of the rotation contact portion 104*c*, and the reverse rotation stopper spring 193 described above is configured to be engaged with, and be disengaged from, the edge face groove 104*d*. Specifically, a vertical slit 192*a* extending in the shaft direction is formed in the upper region of the core shaft portion 192, and the end of the wire member of the reverse rotation stopper spring 193 protrudes from the vertical slit 192*a* to be engaged with the edge face groove 104*d* of the rotation contact portion 104*c*.

When the tape cartridge 100 is carried around, the reverse rotation stopper spring 193 prevents the reverse rotation of the tape roll 106 (printing tape 102). When the tape cartridge 100 is attached into the cartridge attachment portion 5, the reverse rotation stopper spring 193 is compressed by the base convex portion 40 described above, and the end of the wire member of the reverse rotation stopper spring 193 is disengaged from the edge face groove 104*d* of the rotation contact portion 104*c* to release the reverse rotation stopper (see FIG. 10 for both). This release makes it possible to feed the printing tape 102.

As illustrated in FIG. 7, a ribbon housing area 200 is formed adjacent to the insertion opening 134 at the proximal-end right-side region inside the cartridge case 130. An unreeling-side bearing portion 202, which supports the ribbon roll 114 (unreeling core 112) rotatably, is formed integrally with the cartridge case 130 at a relatively right-side region of the ribbon housing area 200, and a reeling-side bearing portion 204, which supports the reeling core 116 rotatably, is formed integrally with the cartridge case 130 at a relatively left-side region of the ribbon housing area 200. That is, the unreeling-side bearing portion 202 and the reeling-side bearing portion 204 are formed in each of the upper case 152 and the lower case 150.

The rotation stopper hooks 206, the ends of which face the unreeling-side bearing portion 202 and the reeling-side bearing portion 204 respectively, are provided at the respective cutout regions of the unreeling-side bearing portion 202 and the reeling-side bearing portion 204 formed in the lower case 150. One of the two rotation stopper hooks 206 is in engagement with the unreeling core 112 in a rotation stopping state. The other rotation stopper hook 206 is in engagement with the reeling core 116 in a rotation stopping state.

A first ribbon guide 210 for guiding the unreeled ink ribbon 110 to the platen roller 120 is provided upright integrally with the lower case 150 in the ribbon housing area 200 at a position near the unreeling-side bearing portion 202. In addition, a plurality of second ribbon guides 212 is formed integrally outside the around-opening surrounding wall portion 164 described above, wherein these guides guide the ink ribbon 110 when ink ribbon 110 goes around it.

That is, a ribbon feeding path 214, which leads from the ribbon roll 114 to the reeling core 116 via the first ribbon guide 210, the platen roller 120, and the plurality of second ribbon guides 212, is provided inside the cartridge case 130. The ink ribbon 110 having been unreeled from the ribbon roll 114 is guided through the first ribbon guide 210 to the platen roller 120, is used for printing at the platen roller 120, is further guided from the platen roller 120 to go around the around-opening surrounding wall portion 164 (through the plurality of second ribbon guides 212), and is finally reeled onto the reeling core 116.

The ribbon roll 114 includes the ink ribbon 110 and the unreeling core 112. The ribbon roll 114 further includes a ring-shaped leaf spring 220 for applying a braking load to the unreeling core 112 (see FIG. 7(*b*)). The leaf spring 220 has a wave pattern in the circumferential direction. In the shaft direction, the leaf spring 220 is provided between the top wall portion 156 of the upper case 152 and the unreeling core 112. That is, due to the resilience of the leaf spring 220, a rotation braking load is applied to the unreeling core 112. Therefore, the ink ribbon 110 unreeled by being taken up by the reeling core 116 is back-tensioned so as to prevent its slackening.

The unreeling core 112 has a cylindrical shape. A plurality of notches 222 is formed in the circumferential direction at the lower-case-side 150 end of the unreeling core 112 (see FIG. 3(*b*)). The rotation stopper hook 206 described above is engaged with, and disengaged from, the notch 222. The unreeling-side bearing portion 202 of the lower case 150 for supporting the unreeling core 112 is a circular opening. The unreeling-side bearing portion 202 of the upper case 152 is a cylindrical protruding portion. The leaf spring 220 described above is mounted on the protruding portion (see FIG. 7(*b*) for both).

Similarly, the reeling core 116 has a cylindrical shape, and a plurality of notches 224 is formed in the circumferential direction at the lower-case-side 150 end of the reeling core 116 (see FIG. 3(*b*)). The rotation stopper hook 206 described above is engaged with, and disengaged from, the notch 224. Spline slit grooves 226 are formed in the inner circumferential surface of the reeling core 116, and these slit grooves are in spline engagement with the reeling drive shaft 47 described above. Because of this structure, the rotation force of the reeling drive shaft 47 is transmitted to the reeling core 116 so as to take up the ink ribbon 110.

A platen housing area 230 is formed adjacent to the insertion opening 134 at the proximal-side left-side region inside the cartridge case 130. A lower bearing portion 234, which is an elliptical opening formed in the lower case 150 (see FIG. 3(*b*)), and an upper bearing portion 232, which is an elliptical opening formed in the upper case 152 (see FIG. 7(*b*)), are formed at the center of the platen housing area 230. The platen roller 120 is supported by the upper bearing portion 232 and the lower bearing portion 234 in such a way as to be able to rotate freely and in such a way as to be able to slightly move laterally. That is, the platen roller 120 supported by the elliptical upper bearing portion 232 and the elliptical lower bearing portion 234 is configured to be able to move laterally (very small movement) between a home position of being in engagement with the platen drive shaft 45 and a nipping position of being in contact with the tape guide 194, with the printing tape 102 nipped.

The tape cartridge 100 is carried around in a state in which the unreeled end part of the printing tape 102 protrudes slightly to the outside through the tape feed outlet 138 (see FIG. 1). When it is carried around, if a pushing force or a pulling force acts on the unreeled end part of the printing tape 102 by mistake, the platen roller 120 drawn by the force moves to the nipping position described above. This movement prevents the unreeled end part of the printing tape 102 from being drawn into the cartridge case 130 through the tape feed outlet 138.

The platen roller 120 includes a cylindrical roller base 240 and a rubber roller 242, which is mounted on the outer circumferential surface of the roller base 240 (see FIG. 7(*a*)). The rubber roller 242 has a length corresponding to that of the print head 21 in the shaft direction. The print head 21 having been moved to the printing position is in contact with the rubber roller 242, with the printing tape 102 and the ink ribbon 110 nipped therebetween.

The spline drive shaft 45*b* of the platen drive shaft 45 is in spline engagement with the base portion of the roller base 240. Because of this engagement, the rotation force of the platen drive shaft 45 is transmitted to the platen roller 120, and the printing tape 102 (and the ink ribbon 110) is fed for printing.

First Embodiment

Next, with reference to FIGS. 8 to 10, the base convex portion 40 and the core concave portion 260 will now be explained in detail (first embodiment). The base convex portion 40 is provided on the cartridge attachment portion 5. The core concave portion 260 corresponding to the base convex portion 40 is provided in the tape cartridge 100.

Figure 8:
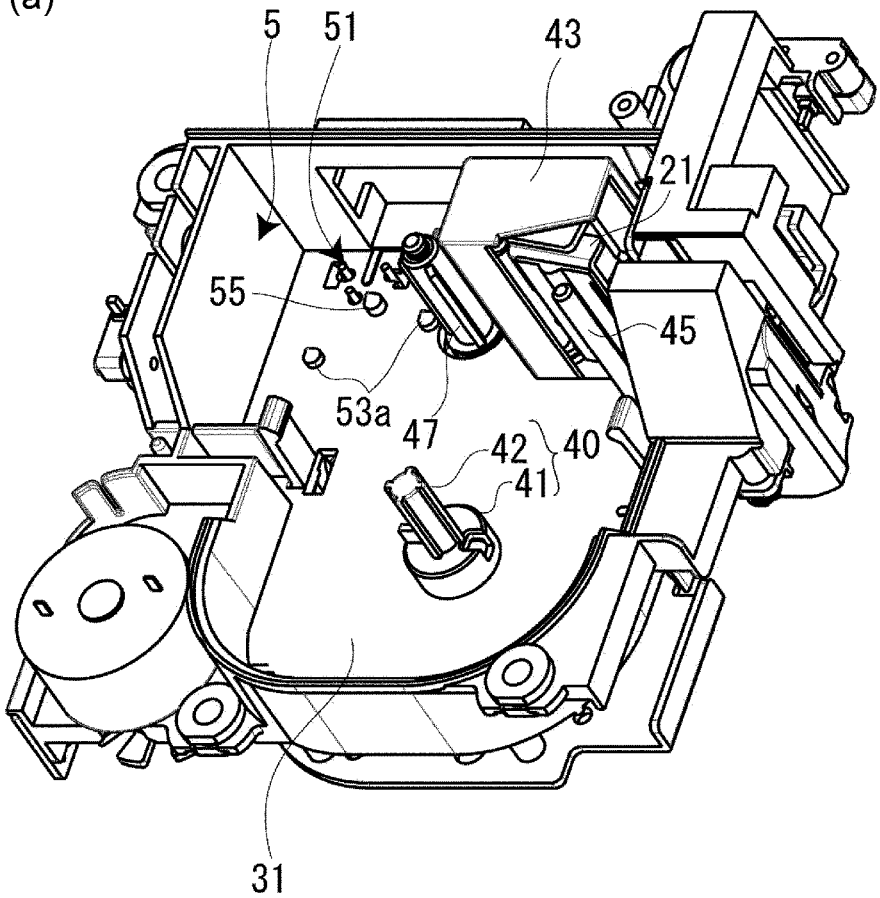
FIG. 8 A perspective view (a) of a cartridge attachment portion, and an enlarged perspective view (b) of a base convex portion.
Figure 8:
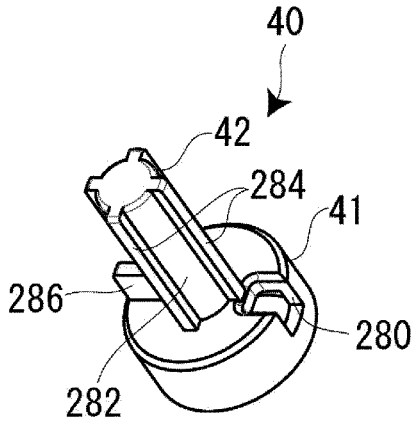
Figure 10:
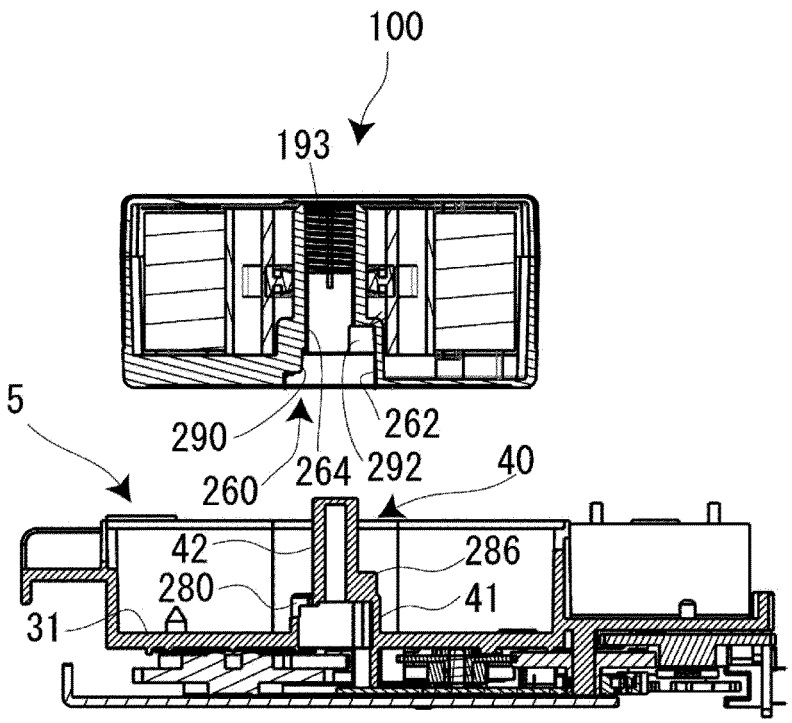
FIG. 10 A cross-sectional view (a) of a state of non-attachment of a tape cartridge into a cartridge attachment portion, and a cross-sectional view (b) of a state of attachment thereof.
Figure 10:
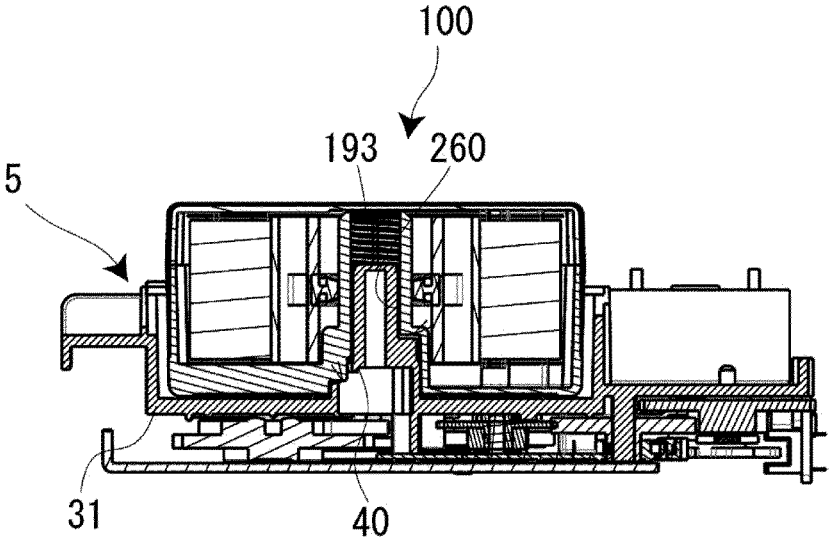

As illustrated in FIGS. 8 and 10, the base convex portion 40 includes the pedestal portion 41, which is provided upright on the attachment base 31, and the identification convex portion 42, which is provided upright on the pedestal portion 41. The pedestal portion 41 and the identification convex portion 42 are formed integrally with each other. The pedestal portion 41 has a circular shape, and includes a cutout opening portion 280 (second concave portion) in its part in the circumferential direction. The identification convex portion 42 includes a columnar (hollow) convex portion body 282, four ridges 284, which are formed on the outer circumferential surface of the convex portion body 282 in a cross layout, and a tongue piece 286 (first convex portion), which protrudes in the radial direction along the top of the pedestal portion 41 from the convex portion body 282.

Figure 9:
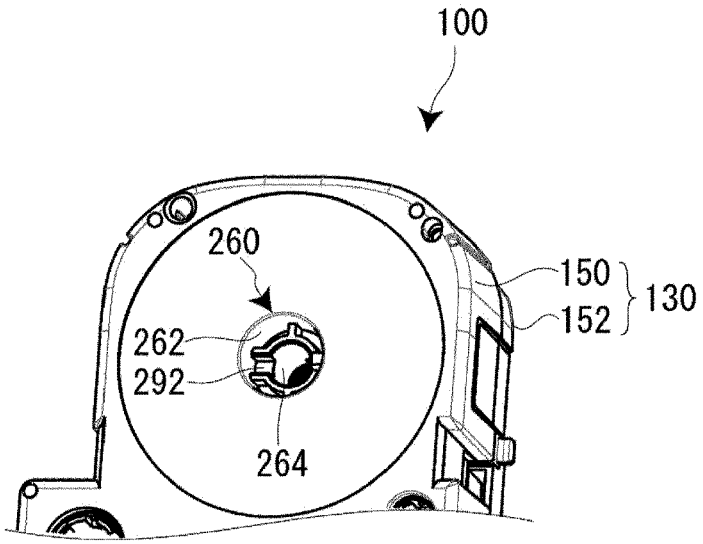
FIG. 9 An enlarged perspective view (a), from the back on the right, of a tape cartridge, an enlarged perspective view (b), from the back on the left, of the tape cartridge, and an enlarged plan view (c) of a core concave portion.
Figure 9:
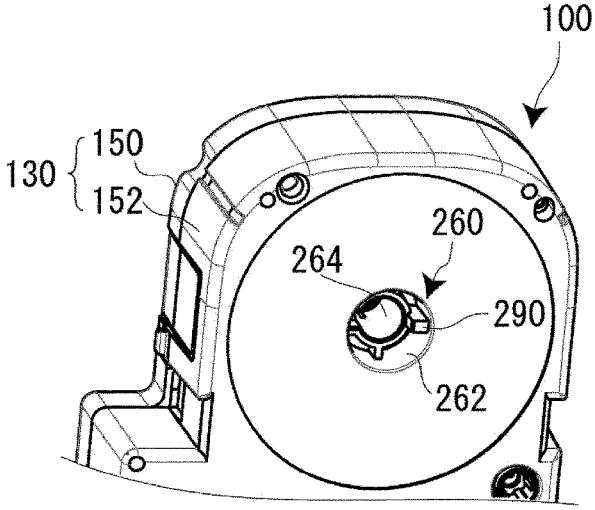
Figure 9:
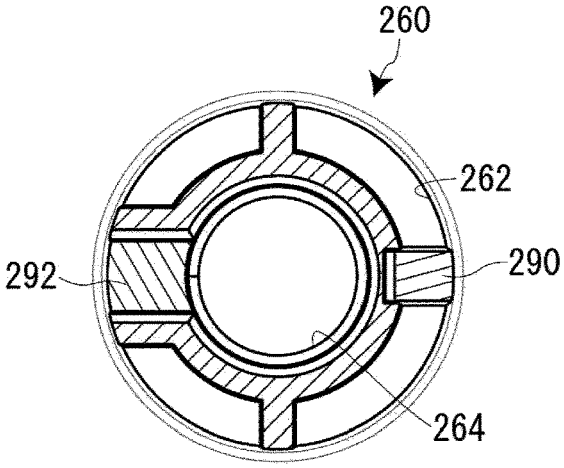

On the other hand, as illustrated in FIGS. 9 and 10, the core concave portion 260 includes the recessed portion 262, into which the pedestal portion 41 of the base convex portion 40 is to fit, and the identification concave portion 264, into which the identification convex portion 42 thereof is to fit. The recessed portion 262 and the identification concave portion 264 constitute a continuous space. A fit-in convex portion 290 (second convex portion), which corresponds to the cutout opening portion 280, is formed in the identification concave portion 264 in such a way as to protrude toward the space in the shaft direction and in the radial direction. A fit-in concave portion 292 (first concave portion), which corresponds to the tongue piece 286 of the identification convex portion 42, is formed in the identification concave portion 264 in such a way as to be recessed in the space in the shaft direction and in the radial direction.

When the tape cartridge 100 is attached into the cartridge attachment portion 5, the pedestal portion 41 of the base convex portion 40 fits into the recessed portion 262 of the core concave portion 260, and, at the same time, the identification convex portion 42 of the base convex portion 40 fits into the identification concave portion 264 of the core concave portion 260 (see FIG. 10). In addition, in accordance with this fit-in engagement, the fit-in convex portion 290 fits into the cutout opening portion 280, and the tongue piece 286 fits into the fit-in concave portion 292.

In the tape cartridge 100 of the present embodiment, the tape roll 106 is heavier than other constituent parts, and the center of gravity lies in the neighborhood of the tape core 104 in plan view. For this reason, when the tape cartridge 100 is held with a hand for attachment, the tape cartridge 100 tends to be inclined toward its tape core 104 with its distal-end side down, unless the user is particularly conscious. In such a case, before the fit-in engagement of the identification convex portion 42 with the identification concave portion 264, the recessed portion 262 often collides with the identification convex portion 42, and the inclined orientation of the tape cartridge 100 is corrected because of this collision. That is, in the process of attachment, the tape cartridge 100 is corrected into level orientation. Therefore, it is possible to perform attachment smoothly.

In the present embodiment, the cooperative functioning of the core concave portion 260 and the base convex portion 40 makes it possible to identify the type of the cartridge. The cartridge type in this case does not mean the type of the printing tape 102 (the tape type is detected by the tape detection portion 51); for example, application (for industrial use or for home use), intended territory of destination (for U.S. or for Europe), or the like is identified. On the other hand, with regard to the tape printing apparatus 1, plural models varying in printing conditions (specification) from one application to another and from one destined territory to another are available.

Though not illustrated, plural types of the tape cartridge 100 for different destined territories (applications) with differences in the position of the fit-in concave portion 292 in the core concave portion 260 in the circumferential direction, for example, with an angular shift in pitch of 90° (phase shift), are available. To correspond to this variation, plural types of the tape printing apparatus 1 for different destined territories (applications) with a shift in the phase of the tongue piece 286 in the base convex portion 40 are available (first identification pattern).

Moreover, in order to increase the number of cartridge types, there is an additional pattern with a shift in the phase of the fit-in convex portion 290 in the core concave portion 260 (a pattern with a shift in the phase of the cutout opening portion 280 in the base convex portion 40) (second identification pattern). In place of the phase shift (the first identification pattern and/or the second identification pattern) or in addition to the phase shift, the shape of the fit-in concave portion 292 (tongue piece 286) and/or the shape of the fit-in convex portion 290 (cutout opening portion 280) may be modified.

As described above, in the first embodiment, the attachment of the tape cartridge 100 into the cartridge attachment portion 5 brings the fit-in convex portion 290 and the fit-in concave portion 292 provided on/in the core concave portion 260 into fit-in engagement with the cutout opening portion 280 and the tongue piece 286 provided in/on the base convex portion 40. By this means, it is possible to confirm that the tape cartridge 100 matches with the specification of the tape printing apparatus 1 (specified for application, for destined territory). Therefore, it is possible to discern whether the tape cartridge 100 matches with the specification of the tape printing apparatus 1 or not on the basis of whether the tape cartridge 100 has been attached properly into the cartridge attachment portion 5 or not. Therefore, printing is performed under proper printing conditions, resulting in predetermined print quality.

Moreover, smooth attachment of the tape cartridge 100 is not impaired because the fit-in convex portion 290 and the fit-in concave portion 292 are provided on/in the recessed portion 262 and because the cutout opening portion 280 and the tongue piece 286 are provided in/on the pedestal portion 41.

Second Embodiment

Figure 11:
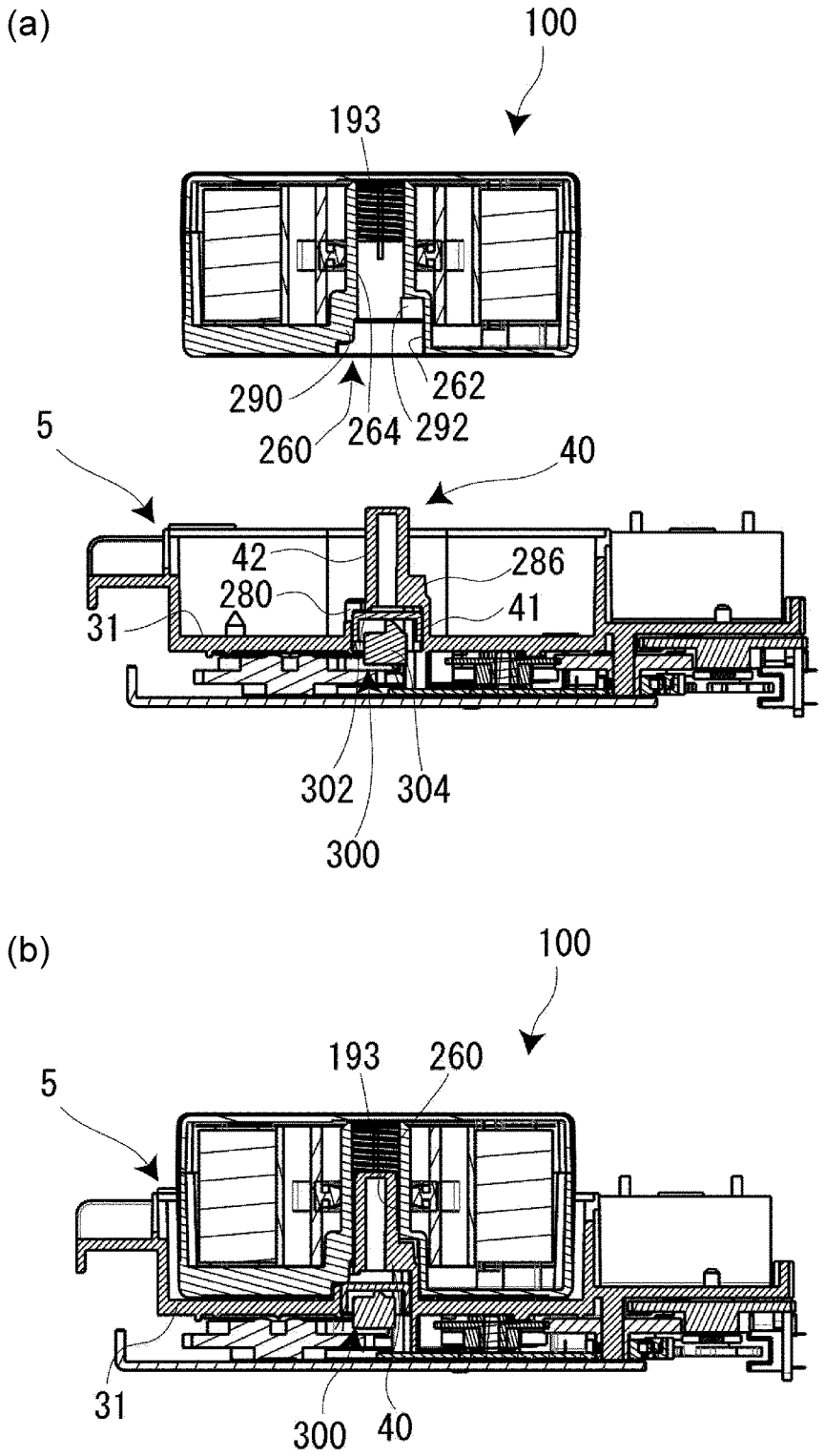
FIG. 11 A cross-sectional view (a) of a state of non-attachment of a tape cartridge into a cartridge attachment portion, and a cross-sectional view (b) of a state of attachment thereof; (first variation example)

Next, with reference to FIG. 11, a second embodiment regarding the neighborhood of the base convex portion 40 will now be explained. As illustrated therein, in the second embodiment, a cartridge detection portion 300 (detection portion) is built inside the base convex portion 40. The cartridge detection portion 300 detects the attachment of a proper tape cartridge 100 in the cartridge type described above by being operated by an operating portion that is the fit-in convex portion 290 (second operating portion) of the core concave portion 260 described above. Therefore, the fit-in convex portion 290 according to the second embodiment functions also as a to-be-detected portion at the tape-cartridge side 100.

The cartridge detection portion 300 is built inside the pedestal portion 41 of the base convex portion 40. The cartridge detection portion 300 includes a to-be-operated member 302 (second to-be-operated portion), which moves downward by being operated by the fit-in convex portion 290, which is the operating portion, and a switch body 304 (second detection portion body), which is in contact with the to-be-operated member 302 from below. The switch body 304 is a micro switch, etc. that is provided in a fixed manner. The to-be-operated member 302 has a shape like a cap, and is provided in such a way as to be able to move up and down freely (slide freely) on the inner circumferential surface of the pedestal portion 41. In this case, the to-be-operated member 302 has moved to an upward movement end position by being urged by the built-in spring of the switch body 304.

The attachment of the tape cartridge 100 into the cartridge attachment portion 5 brings the fit-in convex portion 290 of the core concave portion 260 into fit-in engagement with the cutout opening portion 280 of the base convex portion 40, brings the fit-in convex portion 290 of the core concave portion 260 into contact with the to-be-operated member 302, and causes the to-be-operated member 302 to move down toward the cartridge attachment portion 5. The downward movement of the to-be-operated member 302 activates (ON) the switch body 304. As a result, the attachment of the tape cartridge 100 is detected.

As described above, according to the second embodiment, by providing the cartridge detection portion 300 inside the base convex portion 40, it is possible to detect the proper attachment of the tape cartridge 100 prepared on a destination-by-destination (application-by-application) basis. Moreover, even if the position and/or shape of the cutout opening portion 280 is changed for cartridge identification, it is not necessary to apply any change to the cartridge detection portion 300 because the cartridge detection portion 300 has a structure of activating the switch body 304 via the to-be-operated member 302 and because the to-be-operated member 302 has a shape like a cap.

In a case where there exists (use at) a cold-climate area in the variety of destined territories (applications) of the tape cartridge 100, operation of, for example, switching the tape printing apparatus 1 to a cold-climate area mode may be performed on the basis of the detection result of the cartridge detection portion 300.

Third Embodiment

Figure 12:
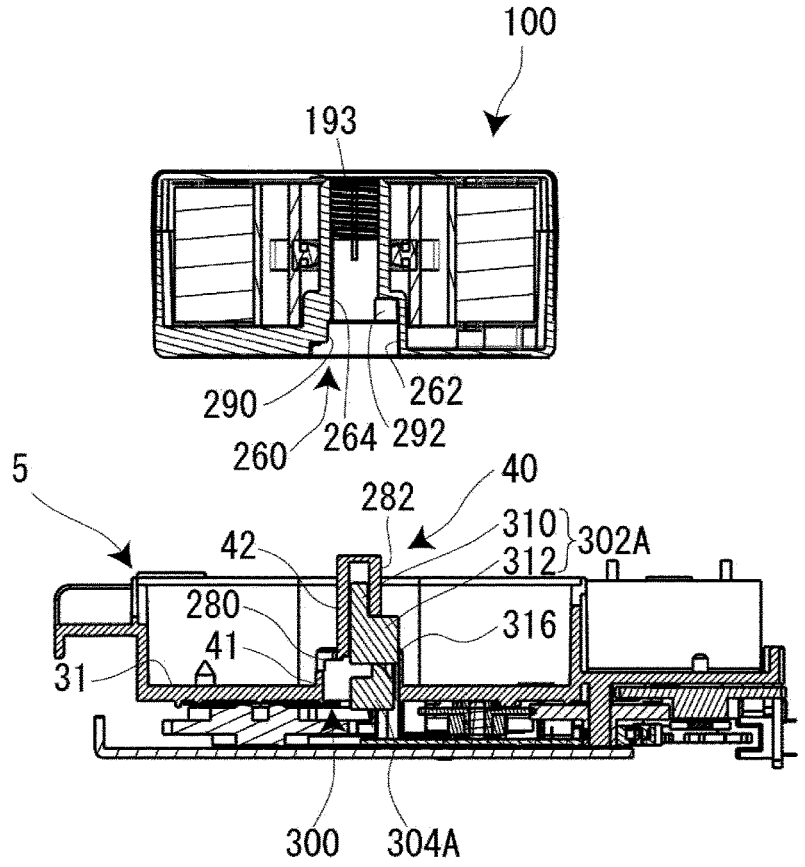
FIG. 12 A cross-sectional view (a) of a state of non-attachment of a tape cartridge into a cartridge attachment portion, and a cross-sectional view (b) of a state of attachment thereof; (second variation example)
Figure 12:
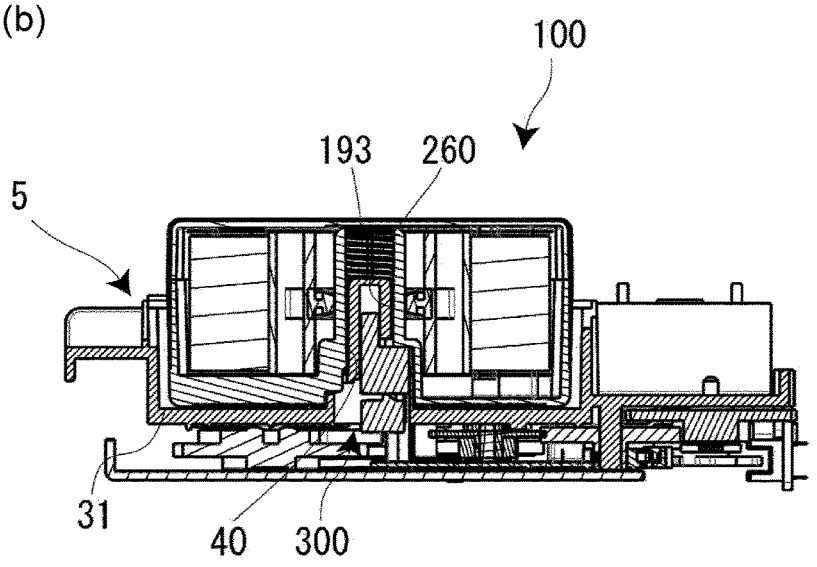

Next, with reference to FIG. 12, a third embodiment regarding the neighborhood of the base convex portion 40 will now be explained. As illustrated therein, in the third embodiment, the cartridge detection portion 300 built inside the base convex portion 40 has a structure in which a to-be-operated member 302A (first to-be-operated portion) doubles as the tongue piece 286. Therefore, in the third embodiment, of the core concave portion 260, the fit-in concave portion 292 (first operating portion) corresponding to the tongue piece 286 functions as a to-be-detected portion at the tape-cartridge side 100. Also in this case, a switch body 304A (first detection portion body) is in contact with the to-be-operated member 302A from below (from the cartridge-attachment-portion side 5). The to-be-operated member 302A is urged by the built-in spring of the switch body 304A upward (in the direction away from the cartridge attachment portion 5).

In the cartridge detection portion 300, the to-be-operated member 302A includes a shaft-like portion 310 and a tongue-like portion 312, which doubles as the tongue piece 286. The shaft-like portion 310 and the tongue-like portion 312 are formed integrally with each other. The shaft-like portion 310 is provided in such a way as to be able to move up and down freely on the inner circumferential surface of the convex portion body 282 of the base convex portion 40 (slide freely in the direction in which the tape cartridge 100 is attached into, and detached from, the cartridge attachment portion 5). The tongue-like portion 312 is provided in such a way as to be able to move up and down freely on an L-shaped slit portion 316, which is provided from a side of the convex portion body 282 to the top of the pedestal portion 41. In this case, in consideration of an operation stroke, the initial position of the tongue-like portion 312 is set to be slightly higher than the position of the tongue piece 286 described above.

The attachment of the tape cartridge 100 into the cartridge attachment portion 5 brings (the top face of) the fit-in concave portion 292 of the core concave portion 260 into fit-in engagement with the tongue-like portion 312 of the to-be-operated member 302A and into contact therewith, and causes the to-be-operated member 302A to move down toward the cartridge attachment portion 5. The downward movement of the to-be-operated member 302A activates (ON) the switch body 304A. As a result, the attachment of the tape cartridge 100 is detected.

As described above, according to the third embodiment, by providing the cartridge detection portion 300 inside the base convex portion 40, it is possible to detect the proper attachment of the tape cartridge 100 prepared on a destination-by-destination (application-by-application) basis. Moreover, because of a structure in which the to-be-operated member 302A doubles as the tongue piece 286, it is possible to reduce the number of parts.

Both of the cartridge detection portion 300 of the second embodiment and the cartridge detection portion 300 of the third embodiment may be built integrally inside the base convex portion 40 (fourth embodiment), although illustration is omitted. In such a case, it is possible to increase the number of types of the tape cartridge 100, and it is possible to detect these kinds of the tape cartridge 100 reliably. Though the switch body 304 is a micro switch in the present embodiment, the switch body 304 is not limited thereto. The switch body 304 may be an optical sensor or the like.

REFERENCE SIGNS LIST

1 tape printing apparatus
3 apparatus case
5 cartridge attachment portion
7 open/close cover
21 print head
23 printing mechanical portion
25 tape feeding mechanical portion
31 attachment base
40 base convex portion
41 pedestal portion
42 identification convex portion
45 platen drive shaft
100 tape cartridge
102 printing tape
104 tape core
106 tape roll
110 ink ribbon
120 platen roller
130 cartridge case
150 lower case
152 upper case
192 core shaft portion
260 core concave portion
262 recessed portion
264 identification concave portion
280 cutout opening portion
282 convex portion body
286 tongue piece
290 fit-in convex portion
292 fit-in concave portion
300 cartridge detection portion
302, 302A to-be-operated member
304, 304A switch body
310 shaft-like portion
312 tongue-like portion

The invention claimed is:

1. A tape printing apparatus to which a tape cartridge is detachably attachable, the tape cartridge comprising a core shaft portion, a roll of printing tape on an outer circumferential portion of the core shaft portion, a core concave portion formed as an inner circumferential portion of the core shaft portion, the core concave portion including a recessed portion and an identification concave portion for identification of a cartridge type, the identification concave portion being provided as a recess from the recessed portion, the apparatus comprising:

a cartridge attachment portion into which the tape cartridge is attachable; and a base convex portion that is provided on the cartridge attachment portion, the core concave portion coming into fit-in engagement with the base convex portion when the tape cartridge is attached to the tape printing apparatus, the base convex portion comprising:

a pedestal portion with which the recessed portion comes into fit-in engagement when the tape cartridge is attached to the tape printing apparatus, and an identification convex portion that is provided as a protrusion on the pedestal portion, the identification concave portion coming into fit-in engagement with the identification convex portion when the tape cartridge is attached to the tape printing apparatus.

2. The tape printing apparatus according to claim 1, wherein the identification concave portion comprises a first concave portion that extends in a radial direction; and wherein the identification convex portion comprises a first convex portion with which the first concave portion comes into fit-in engagement when the tape cartridge is attached to the tape printing apparatus.

3. The tape printing apparatus according to claim 2, wherein the tape cartridge comprises a second convex portion that is provided on the recessed portion and extends in a radial direction; and wherein the pedestal comprises a second concave portion that is provided in the pedestal portion and with which the second convex portion comes into fit-in engagement when the tape cartridge is attached to the tape printing apparatus.

4. A tape printing apparatus to which a tape cartridge is detachably attachable, the tape cartridge comprising a core shaft portion, a roll of printing tape on an outer circumferential portion of the core shaft portion, a core concave portion formed as an inner circumferential portion of the core shaft portion, the core concave portion including a recessed portion and an operating portion for identification of a cartridge type, the apparatus comprising:

a cartridge attachment portion into which the tape cartridge is attachable; and a base convex portion that is provided on the cartridge attachment portion, the core concave portion coming into fit-in engagement with the base convex portion when the tape cartridge is attached to the tape printing apparatus, the base convex portion comprising:

a pedestal portion with which the recessed portion comes into fit-in engagement when the tape cartridge is attached to the tape printing apparatus, and a detection portion with which the operating portion comes into fit-in engagement when the tape cartridge is attached to the tape printing apparatus, wherein the detection portion is configured to be operated by the operating portion to perform detection.

5. The tape printing apparatus according to claim 4, wherein the base convex portion comprises an identification concave portion that is provided as a recess from the recessed portion;

wherein the operating portion comprises a first operating portion that is provided in the identification concave portion and extends in a radial direction;

wherein the base convex portion comprises an identification convex portion that is provided as a protrusion on the pedestal portion; and wherein the detection portion comprises:

a first to-be-operated portion that is provided on the identification convex portion for fit-in engagement with the first operating portion when the tape cartridge is attached to the tape printing apparatus, the first to-be-operated portion being configured to be operated by the first operating portion, and a first detection portion body that is configured to be activated by the first to-be-operated portion for detection.

6. The tape printing apparatus according to claim 5, wherein the first to-be-operated portion is freely slidable in a direction of attachment and detachment of the tape cartridge on an inner circumferential surface of the identification convex portion.

7. The tape printing apparatus according to claim 5, wherein the operating portion includes a second operating portion that is provided on the recessed portion and extends in a radial direction; and wherein the detection portion comprises:

a second to-be-operated portion that is provided in the pedestal portion for fit-in engagement with the second operating portion and is operated by the second operating portion, and a second detection portion body that is configured to be activated by the second to-be-operated portion for detection.

8. The tape printing apparatus according to claim 7, wherein the second to-be-operated portion is freely slidable in a direction of attachment and detachment of the tape cartridge on an inner circumferential surface of the pedestal portion.

9. A tape printing system, comprising:

the tape printing apparatus according to claim 1; and the tape cartridge that is detachably attached into the cartridge attachment portion.

10. A tape printing system, comprising:

the tape printing apparatus according to claim 4; and the tape cartridge that is detachably attached into the cartridge attachment portion.

* * * * *